US005407056A

United States Patent [19]

Akisawa et al.

[11] Patent Number: 5,407,056

[45] Date of Patent: Apr. 18, 1995

[54] APPARATUS AND METHOD FOR DISTRIBUTIVELY FEEDING PLURAL WINDING BOBBINS

[75] Inventors: Taiji Akisawa; Tuneo Yamazaki, both of Kanagawa, Japan

[73] Assignee: Fuji Photo Film Co., Ltd., Kanagawa, Japan

[21] Appl. No.: 132,325

[22] Filed: Oct. 6, 1993

[30] Foreign Application Priority Data

Oct. 19, 1992 [JP] Japan ..... 4-304390

[51] Int. Cl.[6] ..... B65G 47/26

[52] U.S. Cl. ..... 198/432; 198/445; 198/601; 242/35.5 A; 193/25 FT

[58] Field of Search ..... 198/418.6, 432, 445, 198/569, 601; 193/25 FT, 14, 1, 2 R, 3, 4, 25 A, 32

[56] References Cited

U.S. PATENT DOCUMENTS

| | | | |
|---|---|---|---|
| 2,494,939 | 1/1950 | Nance et al. . | |
| 2,500,699 | 3/1950 | Nakaura | 193/32 |
| 2,840,320 | 6/1958 | Csutor . | |
| 2,947,401 | 8/1960 | Schuricht et al. | 193/25 FT |
| 3,008,591 | 11/1961 | Cantelmo | 193/32 |
| 3,191,752 | 6/1965 | Biehn | 198/569 X |
| 3,554,356 | 1/1971 | Milliren | 198/601 X |
| 3,695,539 | 10/1972 | Lindstaedt | 198/432 X |
| 4,377,230 | 3/1983 | Bürner | 193/14 X |
| 4,392,567 | 7/1983 | Glebou et al. | 198/601 X |
| 4,674,940 | 6/1987 | Uchida et al. | 242/35.5 A X |
| 4,810,155 | 3/1989 | D'Agnolo | 242/35.5 A X |
| 4,957,245 | 9/1990 | Spinner | 242/35.5 A |

FOREIGN PATENT DOCUMENTS

| | | |
|---|---|---|
| 0315568 | 5/1989 | European Pat. Off. . |
| 0324709 | 7/1989 | European Pat. Off. . |
| 0360948 | 4/1990 | European Pat. Off. . |
| 233798 | 4/1911 | Germany . |
| WO8706919 | 11/1987 | WIPO . |

*Primary Examiner*—D. Glenn Dayoan
*Attorney, Agent, or Firm*—Sughrue, Mion, Zinn, Macpeak & Seas

[57] ABSTRACT

An apparatus and a method for distributively feeding a plurality of winding bobbins to predetermined locations, wherein the winding bobbins can simultaneously be fitted onto a rotational shaft without the necessity for large-sized equipment. The apparatus includes a distributing section to which a plurality of winding bobbins are fed while arranged in side-by-side relationship as seen in the axial direction. The distributing section includes a plurality of inclined surfaces so as to allow the winding bobbins to be supported from below. After the winding bobbins are placed on the inclined surfaces, they are distributively fed to the predetermined location along the inclined surfaces in the specifically determined direction.

11 Claims, 3 Drawing Sheets

APPARATUS AND METHOD FOR DISTRIBUTIVELY FEEDING PLURAL WINDING BOBBINS

BACKGROUND OF THE INVENTION

The present invention relates to an apparatus and method for distributively feeding a plurality of winding bobbins to a predetermined location in a number corresponding to an amount of work to be performed by a slitter for slitting a band-shaped web such as a magnetic tape, a paper, a film or the like, wherein the bobbins are used for winding the tape or the like therearound.

To manufacture a band-shaped web such as a magnetic tape, a paper, a film or the like, it has hitherto been required to perform a slitting step in the course of a series of production steps for the purpose of slitting the band-shaped web, which is normally prepared in the form of a roll in which the web is wound about a core at a width considerably larger than that of the final product, into products of a predetermined width (i.e., the width of the product). The slitting step is practiced by subjecting a large-width band-shaped web to slitting in a slitter as the web is unwound from the roll.

A plurality of winding bobbins, each being used to wind up a band-shaped article such as a magnetic tape, a paper, a film or tape after being slit from a band-shaped web by actuating the slitter, are generally disposed for winding purposes on a pair of upper and lower rotational shafts at equally spaced intervals, i.e., with a predetermined distance between adjacent winding bobbins, so that a plurality of tapes can be wound around the winding bobbins. While the winding bobbins are arranged on the rotational shafts in the standby state, the forward ends of the slit tapes are wound about the winding bobbins. On completion of the winding operation, the tapes wound on the bobbins are conveyed to a next stage, and subsequently new winding bobbins are arranged on the rotational shafts, thus to repeatedly perform a winding operation.

Here, a conventional winding bobbin feeding method will briefly be described below.

After a plurality of winding bobbins are conveyed while in close contact with each other in the transverse direction, they are individually separated from each other and then fed to a predetermined slitting location where they are disposed in an evenly spaced relationship, with a predetermined slitting width between adjacent winding bobbins. Thereafter, a predetermined number of winding bobbins in close contact with one another are sequentially fed to a predetermined location one by one by dropping each winding bobbin in the downward direction with the aid of a feeding device such as a robot, a shooter, or the like.

However, in the case where each winding bobbin is fed to the foregoing location by operation of a robot or the like, there arises a requirement for improving the winding bobbin exchanging operation from the viewpoint of improved productivity, since about twenty minutes are required for exchanging one set of winding bobbins with another, while a shorter period is required for performing a slitting operation of slitting each band-shaped web having a length of several hundred meters into a plurality of tapes.

In practice, employment of a plurality of robots or the like for fitting a plurality of winding bobbins onto a rotational shaft leads to increased production costs and requires much installation space for the robots. In addition, in the case where one set of winding bobbins is exchanged for a new set by actuating a shooter or the like, there arises a problem that a long time is required for achieving each winding bobbin exchanging operation. That is, a problem arises in that an imbalance occurs between the slitting speed and the time required for carrying out each winding bobbin exchanging operation.

To obviate the foregoing problems relating to the winding bobbin exchanging operation, a proposal has been made, as disclosed in Japanese Patent Laid-Open Publication No. 62-269828, wherein a plurality of rectangular plates each having a predetermined thickness are first set upright on a platform while being placed into close contact with each other. The plates are then simultaneously inclined on the platform until they reach another position while maintaining a close contact state, and thereafter they are stood upright again at the foregoing position where they are separated from one another with a predetermined distance between adjacent plates.

With the proposed method as mentioned above, however, a complicated and costly mechanism is required for practicing the proposed method. In addition, there arises a problem in that the plates are not always uniformly separated from each other due to a difference of resistance against slidable displacement of the plates when the bobbins, which are in close contact with each other, are simultaneously inclined. Other problems are that, among the winding bobbins, two winding bobbins sometimes stick together when inclined without any separation therebetween, and moreover the products on the winding bobbins can be readily damaged by the forward ends of partition plates when they are dropped between the partition plates.

In practice, the proposed method can comparatively easily be executed for rectangular plates, but it is very difficult to employ this method when the bobbins have a circular sectional shape. In addition, the proposed method has a drawback in that it is difficult to displace the plates away from each other with a predetermined distance maintained between adjacent plates while maintaining the foregoing distance during the displacement of the plates.

SUMMARY OF THE INVENTION

The present invention has been made in consideration of the aforementioned background, and an object thereof resides in providing an apparatus and a method for distributively feeding a plurality of winding bobbins wherein it is possible to simultaneously fit a number of winding bobbins onto a rotational shaft without the necessity for installing any large-scale equipment in association with practicing the method or implementing the apparatus of the present invention.

According to one aspect of the present invention, there is provided an apparatus for distributively feeding a plurality of winding bobbins to predetermined locations, wherein the apparatus is characterized in that the apparatus includes a distributing section to which the winding bobbins are fed while they are arranged in a side-by-side relationship as seen in the axial direction, that the distributing section includes a plurality of inclined surfaces so as to allow the winding bobbins to be supported from below, and that after the winding bobbins are placed on the inclined surfaces, they are distributively fed to the predetermined location by rolling along the inclined surfaces in the specifically determined direction.

According to another aspect of the present invention, there is provided an apparatus for distributively feeding a plurality of winding bobbins to predetermined locations, wherein the apparatus is characterized in that the apparatus comprises winding bobbin feeding means for conveying the winding bobbins while they are arranged in a side-by-side relationship as seen in the axial direction, a distributing section where the winding bobbins fed thereto are alternately distributed in opposite directions, an upper arranging section where some of the winding bobbins slantwise fed from the distributing section in one direction with the aid of guiding means are arranged in an equally spaced relationship with a predetermined distance maintained between adjacent winding bobbins, a winding bobbin lowering unit for feeding the remaining winding bobbins to a lower arranging section exhibiting the same functional effect as that of the upper arranging section in the downward direction while they are received in the winding bobbin lowering unit, and arranging boxes disposed at the terminal ends of the upper and lower arranging sections.

According to another aspect of the present invention, there is provided a method of distributively feeding a plurality of winding bobbins to a predetermined location, wherein the method is characterized in that the winding bobbins are placed on a plurality of inclined surfaces of distributing means so as to allow the winding bobbins to be supported from below after the bobbins are arranged in a side-by-side relationship as seen in the axial direction, the inclined surfaces serving to slantwise displace the winding bobbins therealong, and thereafter the winding bobbins are distributively fed along the inclined surfaces in the specifically determined direction.

DESCRIPTION OF THE PREFERRED EMBODIMENTS

The present invention will now be described in detail hereinafter with reference to the accompanying drawings which illustrate preferred embodiments thereof.

Figure 1:
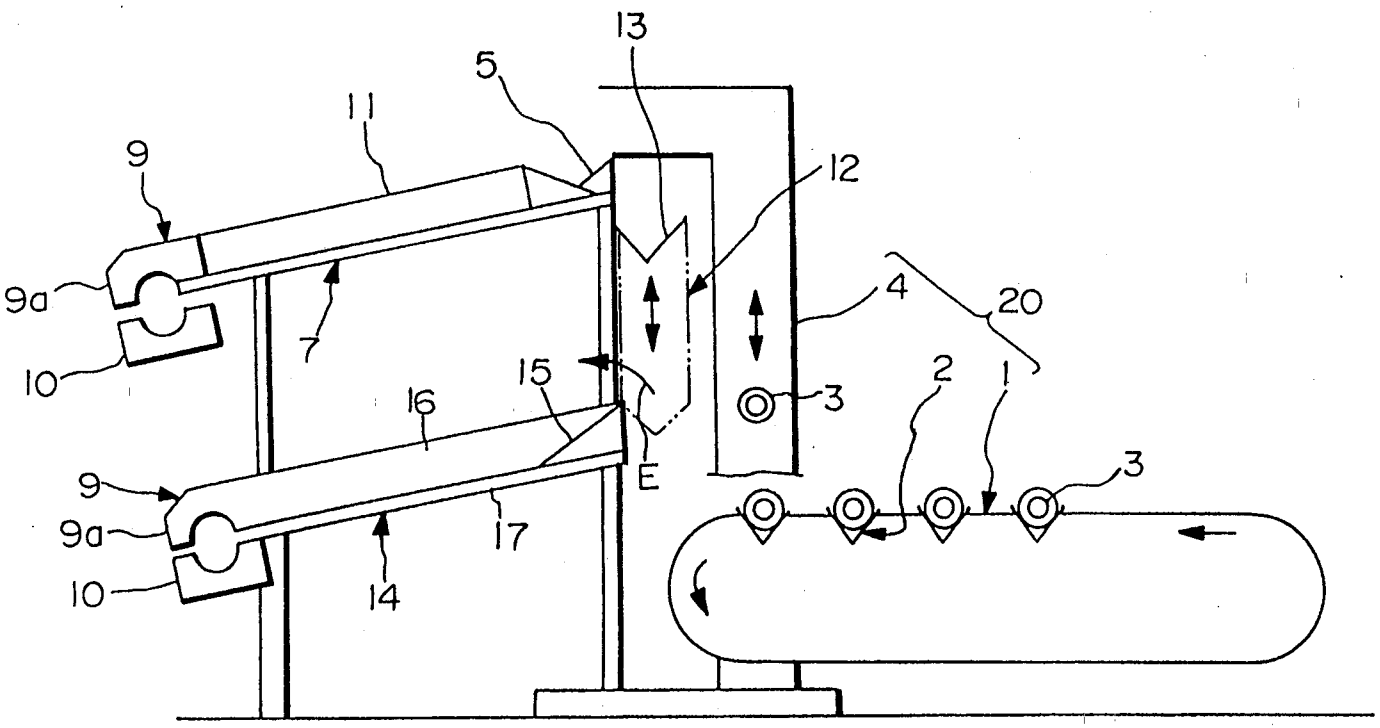
FIG. 1 is a schematic side view of an apparatus for distributively feeding a plurality of winding bobbins according to a preferred embodiment of the present invention.
Figure 2:
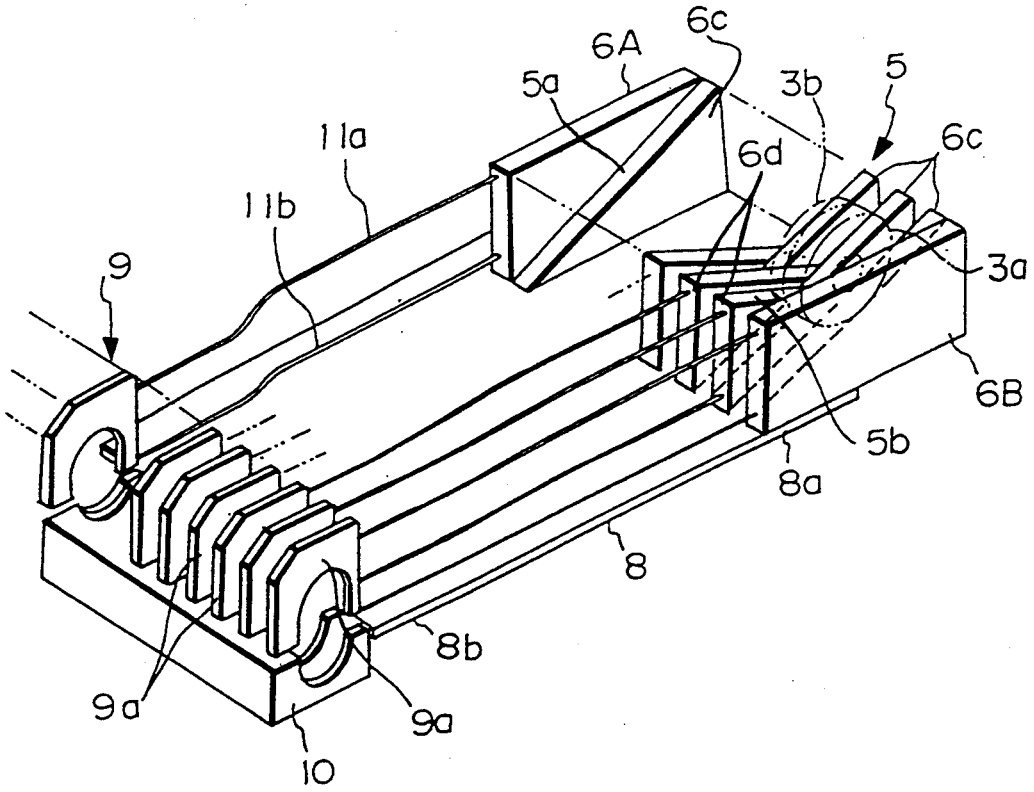
FIG. 2 is a perspective view of the apparatus shown in FIG. 1, particularly showing the structure of a distributing section and an upper arranging section.

FIGS. 1 and 2 show an apparatus constructed according to a preferred embodiment of the present invention for distributively feeding a plurality of winding bobbins. FIG. 1 is a schematic cross-sectional view of the apparatus, particularly showing the overall structure of the apparatus, and FIG. 2 is a fragmentary perspective view of the apparatus, particularly showing essential components of the apparatus.

Referring to FIG. 1, the apparatus includes a winding bobbin feeding unit 20 composed of a winding bobbin conveying unit 1 and a winding bobbin lifting unit 4. The winding bobbin conveying unit 1 is constructed in the form of a bucket conveyor having a plurality of buckets 2 arranged at equal intervals in the circumferential direction while extending in the transverse direction with a V-shaped sectional shape. A plurality of winding bobbins 3, each intended to have a half-finished product or final product of tape wound thereabout, are each arranged in a bucket 2 and are located in close contact with each other in the axial direction. Tapes having a predetermined width are fed from a slitter (not shown) where a band-shaped web is subjected to slitting to form a plurality of tapes. A row of winding bobbins 3 placed in each bucket 2 is simultaneously seized by the winding bobbin lifting unit 4 at a predetermined position on the winding bobbin conveying unit 1, which is opposite the slitter side of the conveying unit 1, and raised to reach a distributing section 5. Alternatively, the winding bobbins 3 can be raised to reach the distributing section 5 after they are simultaneously seized by a transversely extending common shaft inserted through the center of each of the winding bobbins 3, which are brought into close contact with each other.

The feeding of the winding bobbins 3 to the distributing section 5 is achieved while the winding bobbins 3 are held in a side-by-side state on inclined surfaces 5*a* extending in the longitudinal direction from the distributing section 5 and exhibiting a V-shaped contour as seen from the opposite sides. Subsequently, the winding bobbins 3 are distributively fed to an arranging section 9 (described below) while rolling on the inclined surfaces Sa after they are released from the side-by-side state (i.e., the seized state or the close contact state).

As is best seen in FIG. 2, in this embodiment, the distributing section 5 includes a plurality of inclined surfaces 5*a* for holding the winding bobbins 3 thereon and a plurality of triangular cross blocks 6*c* and 6*d*, each having the same thickness as one of the winding bobbins 3. The cross blocks 6*c* and 6*d* are transversely arranged such that a row of cross blocks 6*c*, each having an inclined surface 5*a* slantwise extending in one direction, and a row of cross blocks 6*d*, each having an inclined surface slantwise extending in the opposite direction, are in close contact with each other with the inclined surface 5*a* interposed therebetween, in addition, rectangular end blocks 6A and 6B are located on the opposite sides of the distributing section 5.

The distributing section 5 is mounted on right-hand end parts 8*a* of slightly inclined floor plates 8, each constituting an upper arranging section 7. Another arranging section 9 is mounted on left-hand end parts 8*b* of the floor plates 8. The arranging section 9 is composed of a plurality of guide plates 9*a* transversely arranged at equally spaced intervals in which the intervals are dimensionally coincident with the width of each tape as measured between adjacent guide plates 9*a*. An arranging box 10 is located below the guide plates 9*a*.

Side wall portions 11, each serving as a guide member for widening the distance between adjacent winding bobbins 3*a* as they are rolling along the inclined surfaces 5*a* on the cross block 6*c* side are arranged between the guide plates 9*a* and the end blocks 6A and 6B. In the illustrated case, each side wall portion 11 is composed of an upper guide rod 11*a* and a lower guide rod 11*b*, both of which extend between the guide plates 9*a* and the end blocks 6A and 6B.

As the winding bobbins 3*b* roll along the inclined surfaces 5*b* of the cross blocks 6*d* in a direction opposite the upper arranging section 7, they are received in a trough-shaped bucket 13 of a winding bobbin lowering unit 12 located below the lower ends of the inclined surfaces 5*a*. Subsequently, the bucket 13 is lowered to the start end side of a lower arranging section 14 by activating a driving system (not shown) for the winding bobbin lowering unit 12; In other words, the bucket 13 is lowered to the upper ends of inclined surfaces 15 slantwise extending in the opposite direction relative to the inclined surfaces 5*b* on the cross block 6*d* side, and thereafter the bucket 13 is turned in the counterclockwise direction (i.e., in the direction of the arrow E in FIG. 1) so that the winding bobbins 3*b* received in the bucket 13 are caused to roll along the inclined surfaces 15. As the winding bobbins 3*b* roll along the inclined surfaces 15 and floor plates 17 under their own weight, guided with the aid of side wall portions 16, they reach a lower arranging box 10 in which they are received in the equally spaced relationship.

The winding bobbins 3 arranged in the arranging section 9 in the equally spaced relationship are simultaneously taken up by a fitting shaft (not shown) by inserting the fitting shaft through the winding bobbins 3 received in the arranging box 10. Subsequently, the fitting shaft having the winding bobbins 3 mounted thereon is conveyed to and placed on a slitter (not shown) to start a slitting operation.

As is apparent from the above description, after the winding bobbins 3 are fed to the distributing section 5, they are alternately distributed in opposite directions so that they are exactly arranged in the upper and lower arranging sections 9 with a predetermined distance between adjacent winding bobbins 3. With this construction, a number of winding bobbins 3 can be arranged simultaneously in a very short time compared with the conventional apparatus, in other words, the time required for executing the arranging step can be shortened to a time period comparable with the time required for executing a slitting step in the slitter, resulting in the productivity of the apparatus being substantially improved.

The present invention is not be limited to the preceding embodiment. For example, the winding bobbin feeding unit 20, the winding bobbin lowering unit 12, the side wall portions 11 and 16 and the arranging section 9 may be designed in a different manner as desired. In addition, the distributing section 5 may be designed as illustrated in FIGS. 3 through 5.

Figure 3:
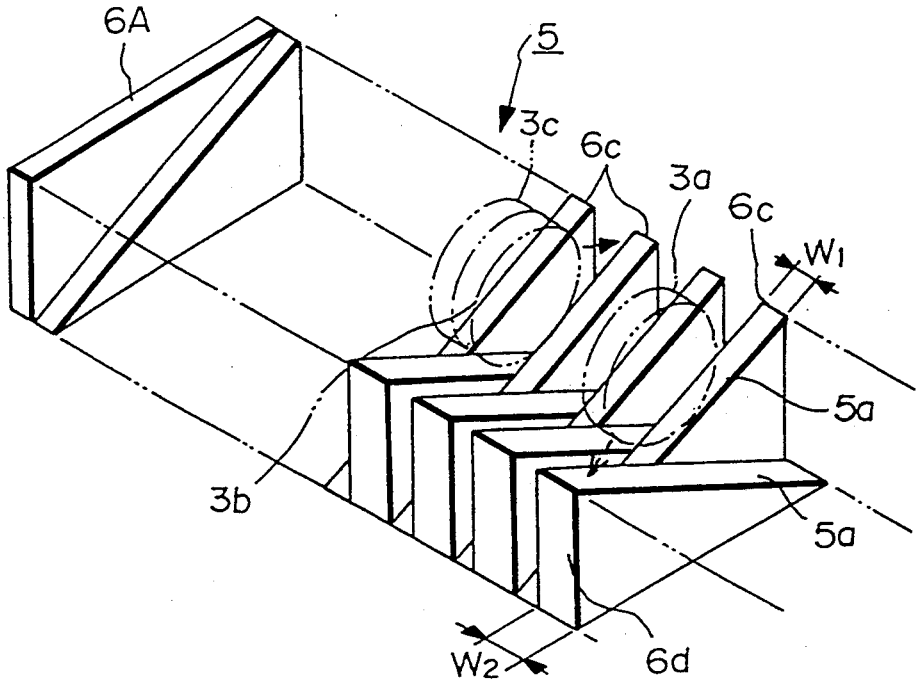
FIG. 3 is a fragmentary perspective view of an apparatus for distributively feeding a plurality of winding bobbins according to another embodiment of the present invention.
Figure 4A:
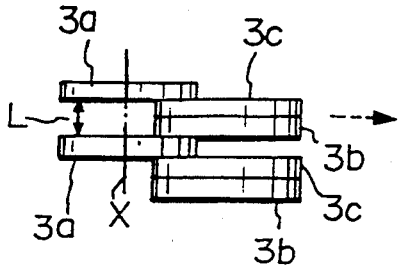
FIGS. 4(A) and 4(B) are fragmentary plan views of the apparatus shown in FIG. 3, schematically showing the case where winding bobbins are distributed in three rows.

In the case of a distributing section 5 as shown in FIG. 3, a plurality of cross blocks 6*d*, each having a width corresponding to the width $W_2$ of two winding bobbins 3, and a plurality of cross blocks 6*c*, each having a width corresponding to a width $W_1$ of a single winding bobbin 3, are alternately arranged in a side-by-side relationship, as seen in the transverse direction, while the direction of slantwise extension of an inclined surface 5*a* of each cross block 6*d* is opposed to the direction of slantwise extension of an inclined surface 5*a* of each cross block 6*c*. In this modified embodiment, as shown in FIG. 4(A), as winding bobbins 3 are fed to the distributing section 5, some of the winding bobbins 3 are distributed into a first group of the type composed of two winding bobbins 3*b* and 3*c* in close contact with each other, while the remaining winding bobbins 3 are distributed into a second group of the type composed of winding bobbins 3*a* spaced from each other with a distance L therebetween. In this case, the winding bobbins 3*b* and 3*c* being to the first group are fed to the distributing section 5 in a ratio of 2:1 in number relative to the winding bobbins 3*a* belonging to the second group.

Figure 4B:
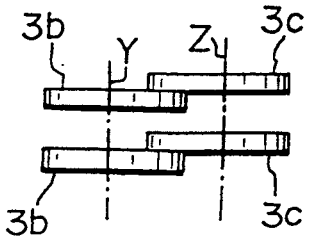

Subsequently, the winding blocks 3*b* and 3*c* belonging to the first group are separated from each other with the aid of a cross block (not shown) as shown in FIG. 4(B), whereby all the winding bobbins 3 fed to the distributing section 5 are arranged in conformity with three rows X, Y and Z. The distributive arrangement of the winding bobbins in conformity with plural rows in the above-described manner may equally be applied to the case where they are arranged in conformity in four or more rows.

Figure 5:
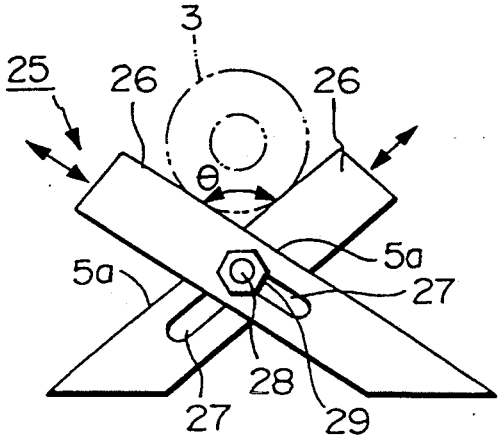
FIG. 5 is a fragmentary side view of an apparatus for distributing feeding a plurality of winding bobbins according to another embodiment of the present invention, particularly showing the structure of a distributing section.

In the case that a distributing section 25 is constructed as shown in FIG. 5, an insert shaft 28 is inserted through elongated holes 27 formed through a number of rod-shaped cross bars 26, and the cross bars 26 are then fixedly secured to each other by threadedly tightening a nut 29 so that a cross angle $\theta$ is defined between an inclined surface 5*a* of one cross bar 26 and that of an adjacent cross bar 26. With this construction, the inclination angle of each inclined surface 5*a* and the length of extension of the inclined surface 5*a* can adequately be adjusted corresponding to the diameter of each winding bobbin 3.

As described above, according to the present invention, a plurality of winding bobbins are fed to the distributing section including a plurality of inclined surfaces so as to hold the winding bobbins from below while allowing them to be slantwise displaced. Subsequently, while the winding bobbins are arranged in conformity with a specific row as seen in the axial direction, they are released from the retained state in the distributing section so that they are distributively fed to a predetermined location along the inclined surfaces of cross blocks in the specifically predetermined direction.

Thus, the winding bobbins can be fed to predetermined locations within the working time of the slitter, that is, without requiring a longer time than required for the slitting step, as is often the case with the conventional apparatus, resulting in the operational efficiency of the apparatus being substantially improved. In addition, since the apparatus of the present invention does not include any mechanical driving/slidable displacement portion, and moreover, each winding bobbin rolls under its own weight, mechanical wear and associated problems hardly occur on essential components of the apparatus. Thus, the handling time can substantially be reduced by simultaneously feeding a plurality of winding bobbins to the distributing section, resulting in the productivity of the apparatus being remarkably improved.

What is claimed is:

1. An apparatus for distributively feeding a plurality of winding bobbins to predetermined locations, comprising: a distributing section, and means for feeding a plurality of winding bobbins to said distributing section in a side-by-side relationship in which the axes of the bobbins are parallel with one another, said distributing section comprising a plurality of inclined surfaces to support said winding bobbins from below, wherein, after said winding bobbins are placed on said inclined surfaces, said winding bobbins are distributively fed to respective predetermined locations by rolling along said inclined surfaces in a predetermined direction;

wherein said distributing section comprises a stack of a plurality of triangular cross blocks each having the same thickness as one of said winding bobbins and each having a slanting surface, said cross blocks being transversely arranged such that the slanting surfaces of alternating ones of said cross blocks slant in opposed directions.

2. The apparatus for distributively feeding winding bobbins of claim 1, wherein said distributing section further comprises a pair of rectangular end blocks disposed at respective ends of said stack of said cross blocks.

3. The apparatus for distributively feeding winding bobbins of claim 1, wherein said distributing section further comprises a plurality of side wall portions serving as guides for said bobbins as said bobbins roll down said distributing section to said predetermined positions.

4. The apparatus for distributively feeding winding bobbins of claim 3, wherein said side wall portions are arranged at a widening pitch in a direction in which said bobbins roll down said distributing section.

5. The apparatus for distributively feeding winding bobbins of claim 4, wherein said side wall portions each comprise an upper guide rod and a lower guide rod.

6. An apparatus for distributively feeding a plurality of winding bobbins to predetermined locations, comprising: a distributing section, and means for feeding a plurality of winding bobbins to said distributing section in a side-by-side relationship in which the axes of the bobbins are parallel with one another, said distributing section comprising a plurality of inclined surfaces to support said winding bobbins from below, wherein, after said winding bobbins are placed on said inclined surfaces, said winding bobbins are distributively fed to respective predetermined locations by rolling along said inclined surfaces in a predetermined direction;

wherein said distributing section comprises a stack of a plurality of triangular cross blocks, alternate ones of said triangular cross blocks having the same thickness as one of said winding bobbins, and ones of said triangular cross blocks between said alternate ones having a thickness as twice the thickness of one of said winding bobbins, each of said triangular cross blocks having a slanting surface, said cross blocks being transversely arranged such that the slanting surfaces of alternating ones of said cross blocks slant in opposed directions.

7. An apparatus for distributively feeding a plurality of winding bobbins to predetermined locations, comprising: an upper and a lower distributing section, each of said distributing sections comprising a plurality of inclined surfaces to support said winding bobbins from below, and a stack of a plurality of triangular cross blocks each having the same thickness as one of said winding bobbins and each having a slanting surface, said cross blocks being transversely arranged such that the slanting surfaces of alternating ones of said cross blocks slant in opposed directions, wherein, after said winding bobbins are placed on said slanted surfaces, they are distributively fed to respective predetermined locations by rolling along said inclined surfaces, means for feeding a plurality of winding bobbins to said upper distributing section in a side-by-side relationship in which the axes of the bobbins are parallel with one another, wherein a first half of said bobbins fed to said upper distributing section are separated by said cross blocks of said upper distributing section and roll along said inclined surface of said upper distributing section, means for transporting a second half of said bobbins separated by said cross blocks of said upper distributing section from said upper distributing section to said lower distributing section, and receiving boxes disposed at terminal end parts of said upper and lower distributing sections.

8. The apparatus for distributively feeding winding bobbins of claim 7, wherein each of said upper and lower distributing sections further comprises a pair of rectangular end blocks disposed at respective ends of said stack of said cross blocks.

9. The apparatus for distributively feeding winding bobbins of claim 8, wherein each of said upper and lower distributing sections further comprises a plurality of side wall portions serving as guides for said bobbins as said bobbins roll down said distributing section to said predetermined positions.

10. The apparatus for distributively feeding winding bobbins of claim 9, wherein said side wall portions are arranged at a widening pitch in a direction in which said bobbins roll down said distributing section.

11. The apparatus for distributively feeding winding bobbins of claim 10, wherein said side wall portions each comprise an upper guide rod and a lower guide rod.

* * * * *